United States Patent [19]

Grimm et al.

[11] 4,421,302

[45] Dec. 20, 1983

[54] PREFABRICATED ADJUSTABLE HANDRAIL ASSEMBLY

[76] Inventors: William G. Grimm, 29974 Paint Brush Dr., Evergreen, Colo. 80439; Ronald W. Pott, 730 Crescent La., Lakewood, Colo. 80215

[21] Appl. No.: 229,888

[22] Filed: Jan. 30, 1981

[51] Int. Cl.[3] ..... F04H 17/14; F16B 9/00; F16C 11/00; F16D 1/12

[52] U.S. Cl. ..... 256/67; 256/59; 256/65; 403/71; 403/87; 403/121

[58] Field of Search ..... 256/67, 65, 68, 69, 256/59, 21, 22; 403/187, 188, 189, 262, 70, 71, 87, 121; 52/182, 183, 149

[56] References Cited

U.S. PATENT DOCUMENTS

| | | | |
|---|---|---|---|
| 1,578,634 | 3/1926 | Borgmann | 403/71 |
| 3,258,251 | 6/1966 | Culter | 256/24 X |
| 3,289,381 | 12/1966 | Blum et al. | 52/730 |
| 3,306,586 | 2/1967 | Green | 256/22 X |
| 3,356,392 | 12/1967 | Blum et al. | 287/20.924 |
| 3,707,276 | 12/1972 | Francis et al. | 256/65 X |
| 3,804,374 | 4/1974 | Thom | 256/59 |
| 4,112,195 | 9/1978 | Pott et al. | 428/542 |
| 4,272,061 | 6/1981 | Suckno | 256/22 X |

*Primary Examiner*—Richard J. Scanlan, Jr.
*Attorney, Agent, or Firm*—John E. Reilly

[57] ABSTRACT

A prefabricated handrail assembly is conformable for use along horizontal or inclined surfaces and is characterized by being adjustable in accordance with the pitch or degree of rise along the surface while retaining the upper and lower rail portions in spaced parallel relation to one another with the balusters extending vertically between the rail portions. Fasteners at opposite ends of the rail portions will automatically conform to differences in the angle between the rail portions and end posts to which they are connected, and a unique bracket or hold-down device is provided for connection to each newel post.

14 Claims, 7 Drawing Figures

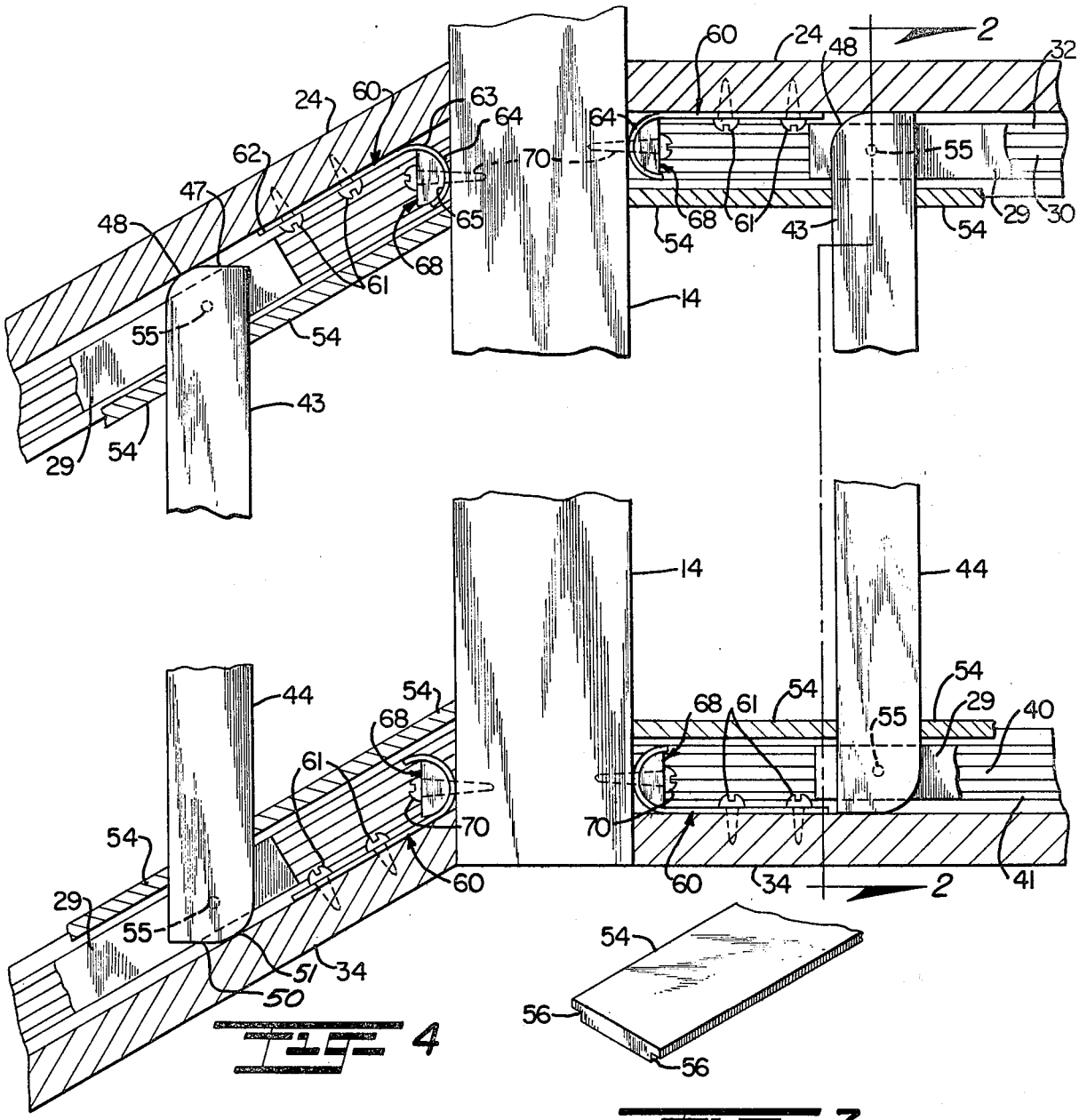
FIG. 4
FIG. 7
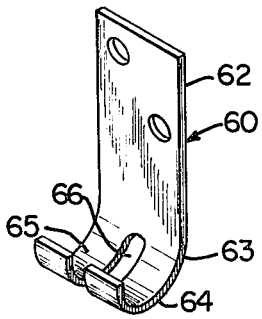
FIG. 5
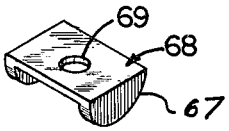
FIG. 6

PREFABRICATED ADJUSTABLE HANDRAIL ASSEMBLY

This invention relates to novel and improved handrail assemblies, and more particularly relates to prefabricated handrail assemblies which are adaptable for use as railings, balustrades and the like.

BACKGROUND AND FIELD OF THE INVENTION

Decorative handrails are customarily comprised of upper and lower rail portions which extend between or traverse the length of the railing between newels or end posts, and balusters extend vertically between the handrails at longitudinally spaced intervals. The construction and assembly of such hand railings at the job site requires the exercise of a great deal of skill and care, particularly since the angular relationship established between the balusters and rail portions will vary with the inclination or pitch of the staircase or other surface with which it is associated. Most exacting and time-consuming is to properly align the balusters in precise vertically extending, equally spaced relation to one another along the inclined portions of a staircase once the rail portions are properly cut to length and fastened in place between the newels or end posts. Swivel or pivotal type connectors have been devised in the past for use in railing systems and for example reference is made to U.S. Pat. No. 3,804,374 to Thom as well as U.S. Pat. Nos. 3,356,392 and 3,289,381 to Blum et al. Further, the desirability of providing composite moldings which can be interchangeably employed and interfitted in different combinations by professionals and novices alike in constructing handrails for decorative and functional purposes is disclosed in U.S. Pat. No. 4,112,195 granted to applicants to this invention. The invention disclosed therein has to do more with the composite molding elements making up the rail portions and which are laminated together in a variety of combinations to build up a composite molding structure of a preselected size and shape.

The present invention is more concerned with the provision for an adjustable handrail system which permits the desired latitude in the selection of baluster and handrail designs and which will greatly facilitate on-site installation by professionals or novices; yet is adjustable at the installation site to conform to any variations in pitch or inclination of the base surface along which it extends.

SUMMARY OF THE INVENTION

It is therefore an object of the present invention to provide for a novel and improved handrail system comprised of a minimum number of prefabricated components or sub-assemblies which can be installed in an efficient and reliable manner.

Another object of the present invention is to provide for a novel and improved prefabricated railing assembly which is adjustable in accordance with the pitch or degree of rise of the surface with which it is associated, such as, a staircase or other inclined surface and can be installed in place in a minimum number of steps; and further wherein different selected baluster and handrail assemblies can be interchangeably used in a variety of combinations to construct handrail systems with individually desired characteristics of size, shape and appearance while concealing the means employed to fasten the individual components together.

It is an additional object of the present invention to provide for novel and improved fastener elements which are automatically adjustable to conform to differences in the angle formed between the parts to be connected in a handrail system while lending the necessary structural rigidity to the system.

A still further object of the present invention is to provide for a novel combination and arrangement of elements adaptable for use in a handrail system and which have particular utility in the prefabrication of railings, balustrades, parapets and like applications, the system being characterized in particular by its adjustability in pitch and interchangeability to conform to different desired sizes and shapes.

In accordance with the present invention, an adjustable prefabricated handrail assembly has been devised which can be assembled between a pair of upstanding newels, the assembly being broadly comprised of upper and lower rails having channel portions extending the length of the rails with the open ends of the channels disposed in facing relation to one another. A plurality of balusters extends between the rails with means pivotally interconnecting opposite ends of the balusters in spaced relation to one another along the length of the rails and in concealed relation within the channels so as to prevent pivotal movement in a direction lengthwise of the rails, and fastener elements interconnect the end of each rail to one of the newels so as to automatically align the balusters in horizontally spaced, vertically extending relation between the upper and lower rails. Preferably, the balusters are preassembled in desired spaced relation to one another by connecting strips extending along opposite ends of the balusters and to which the balusters are pivotally connected, the connecting strips being insertable into a complementary slot or slots formed in the channels in the rails. The fastener elements are arranged in the channels at opposite ends of the rails so as to be concealed and permit direct fastening of the rails to the newels while limiting movement of the balusters with respect to the rails once positioned therebetween. Preferably, each fastener is in the form of a metal strip having a reverse-curved end portion and which is slotted lengthwise for insertion of a threaded fastener therethrough. The threaded fastener is preferably used in combination with a shim of generally semi-cylindrical configuration and whose cylindrical surface will conform to that of the curved end of the fastener. Thus, the fastener will firmly bear against the side of the newel and permit the shim and threaded element to automatically align themselves irrespective of the angle formed between the rail and the end post.

The above and other objects, advantages and features of the present invention will become more readily appreciated and understood from a consideration of the following detailed description of a preferred embodiment of the present invention when taken together with the accompanying drawings, in which:

BRIEF DESCRIPTION OF THE DRAWINGS

FIG. 4 is an enlarged view in detail and partially in section of the preferred form of handrail assembly;

FIG. 5 is a perspective view of a preferred form of fastener element;

FIG. 6 is an enlarged perspective view of a preferred form of shim used in association with the fastener of FIG. 5; and FIG. 7 is a fragmentary perspective view illustrating a portion of the filet inserted between the balusters and channel portions of the handrails in accordance with the present invention.

DETAILED DESCRIPTION OF THE PREFERRED EMBODIMENT

Figure 1:
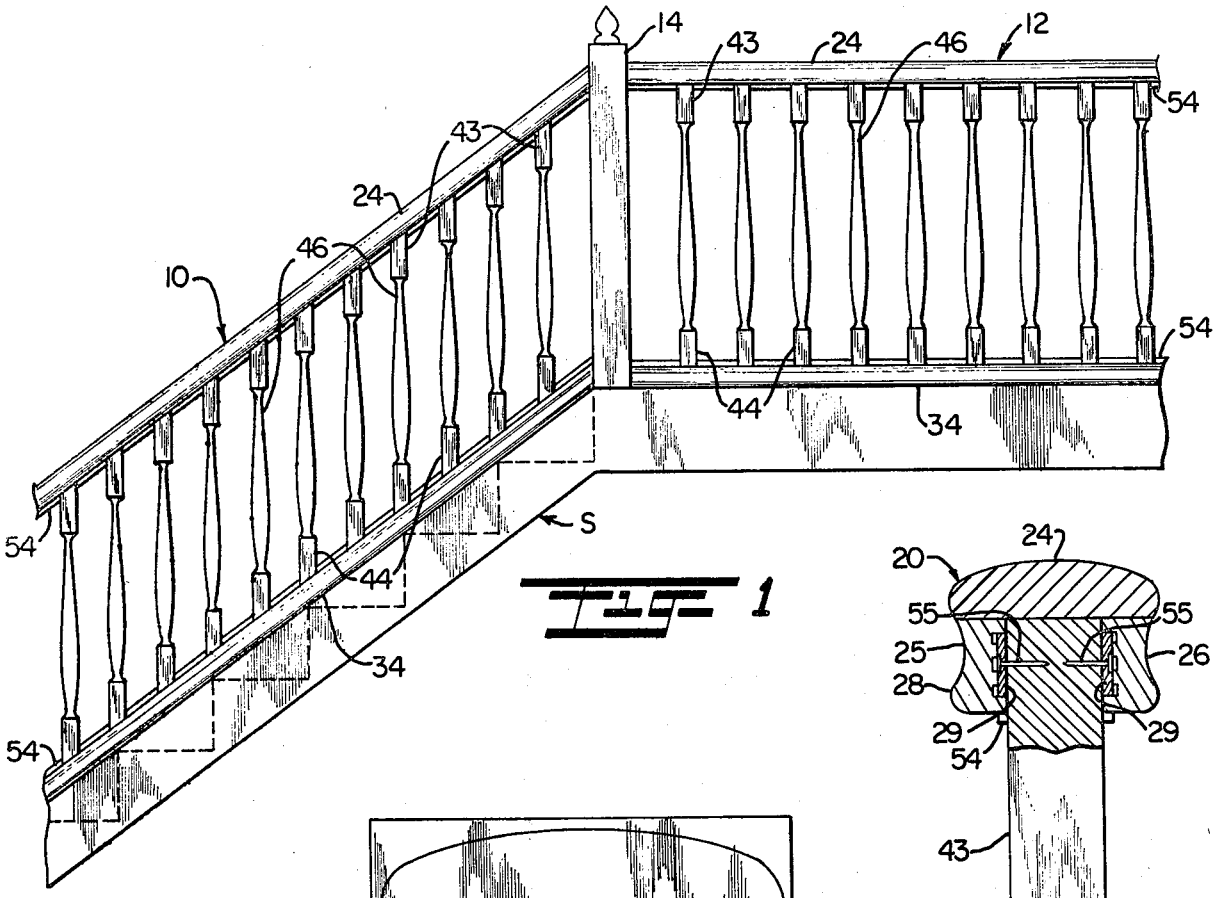
FIG. 1 is a front view in elevation of a preferred form of handrail system according to the present invention.

Referring in detail to the drawings, there is shown by way of illustrative example in FIG. 1 the installation of a pair of handrail assemblies 10 and 12 formed in accordance with the present invention along inclined and upper horizontally extending portions of a staircase represented at S, each of the handrail assemblies 10 and 12 being anchored to a common newel or end post 14 and, at the their opposite ends, the handrail assemblies being anchored to individual newels, not shown.

Each handrail assembly 10 and 12 is of corresponding construction but will of course vary in length according to the relative lengths of the inclined and horizontally extending portions along which they extend. Important to a consideration of the present invention however is the ability of the handrail assemblies 10 and 12 to automatically conform to the inclination or pitch, or lack of same, between the newels 14 so that the assemblies may be prefabricated in a manner to be hereinafter described, then installed at the job site by the simple expedient of fastening opposite ends of the assemblies directly into the newels by a novel form of fastener 60, as illustrated in FIGS. 4 to 6.

Figure 2:
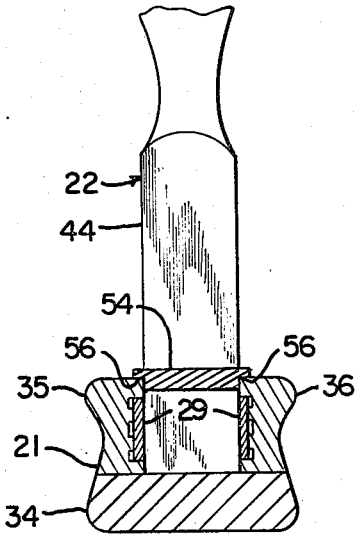
FIG. 2 is a cross-sectional view illustrating the interconnection between parts comprising the preferred form of handrail.

Referring to FIG. 2, each handrail assembly 10 and 12 is correspondingly comprised of an upper rail 20, a lower or bottom rail 21 and a plurality of balusters 22 extending between the upper and lower rails 20 and 21 in equally spaced relation to one another along the length of the rails. The upper rail 20 includes an upper convex cap member 24 having downwardly projecting, opposite sides 25 and 26 which form with the cap 24 a generally U-shaped channel insertion of the upper ends of the balusters 22. Each sidewall 25 and 26 includes a decorative or contoured exterior surface 28 and an inner facing surface in which is formed a longitudinal groove 30 having formed in the bottom or inner surface of the groove closely spaced longitudinally extending ribs 32. In turn, the lower rail 21 has a bottom cap 34 with upwardly extending sidewalls 35 and 36 positioned on opposite sides of the upper surface of the bottom cap 34 to form a channel provided with inner facing surfaces in which are formed longitudinally extending grooves 40. The grooves 40 include closely spaced ribs 41 formed along the bottom surface of the groove in the same manner as described with reference to the grooves 30 and ribs 32 in the upper handrail 20.

Figure 3:
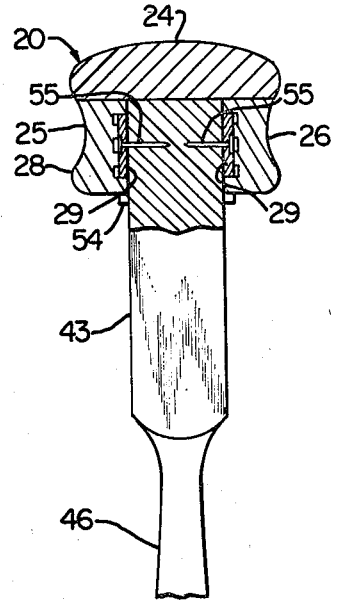
FIG. 3 is an enlarged view in detail illustrating the preferred form of construction of the upper and lower handrails from a common block of material.
Figure 3:
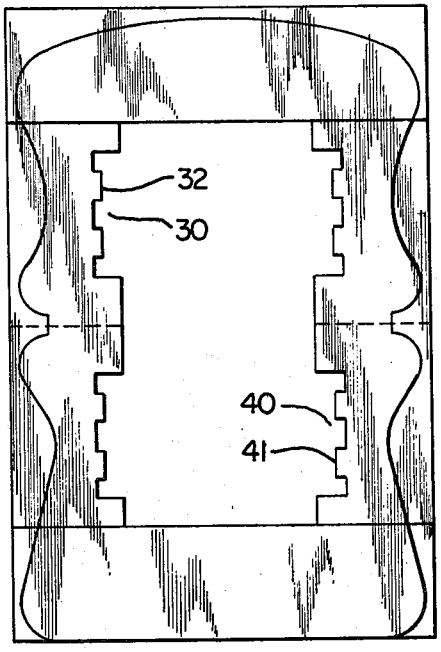

FIG. 3 is intended to illustrate one preferred manner of forming the upper and lower rails 20 and 21 out of a common block of material so that the sides 25 and 26 of the upper handrail and sides 35 and 36 of the lower handrail can be formed together with the upper and lower cap members 24 and 34 in a single operation, then divided into the individual rail portions by separating along the intermediate dotted line as shown.

As seen from a further consideration of FIGS. 4 through 7, inclusive, the balusters 22 have upper and lower end portions 43 and 44 of generally rectangular cross-section interconnected by a decorative, generally cylindrical intermediate portion 46, as shown in FIG. 1. Each upper and lower end portion 43 and 44 is of generally rectangular cross-section, the upper end portion 43 having an end surface 47 which is rounded or beveled at one corner 48. Similarly, the lower end portion 44 has an end surface 50 which is rounded or beveled along one corner 51 which is diagonally opposite to the rounded corner 48 of the upper end portion. The balusters are interconnected in spaced relation to one another and preassembled by means of connecting strips 29, there being a pair of strips extending along opposite sides of each of the upper and lower end portions 43 and 44 in closely spaced relation to the end surfaces 47 and 50, respectively. The strips 29 are generally rectangular in cross-section and are pivotally connected to the balusters by suitable means, such as, nails 55, which are driven into a center point of the end portions 43 and 44 adjacent to their ends such that a slight space is left between the edge of each strip 29 and the respective end surface 47 or 50 as the case may be. In this relation, each strip is of a width corresponding to the width of a groove 30 or 40 in the channel-shaped rails 20 and 21 and is of a length to extend the substantial length of each rail. Here the length of each strip is such that the strips 29 extend just beyond the last baluster at each end, for example, as illustrated in FIG. 4.

In order to secure the preassembled balusters to the newels 14, a preferred form of fastener 60 is adapted to be secured in the bottom or inner surface of each groove 30 or 40 by suitable means such as wood screws 61, and is mounted flush to the end of the rail so as to facilitate fastening directly to the newels. Each fastener 60 is made up of a bracket having a flat base or plate portion 62 and a curved end 63 which is of generally arcuate or semi-circular configuration with an exterior convex surface 64 and an interior concave surface 65. An open slot 66 extends lengthwise intermediately between opposite side edges of the curved end 63. A shim 68 is illustrated in FIG. 6 and forms a part of the fastener assembly, the shim having semi-cylindrical sides or legs 67 at opposite ends, the shim being sized for insertion within each of the curved ends 63. Each shim 68 is provided with a central bore 69 for insertion of a suitable fastener, such as, a hexhead or slotted screw as designated at 70 in FIG. 4. The angular disposition of the shim 68 relative to the curved end 63 will depend upon the angle established between the rail and end posts and therefore the shim is free to be shifted relative to the curved end 63. Thus, notwithstanding variations in the angle between the rails and newel 14, the fastener 60 and shim 68 will permit insertion of the screw 70 through the curved end 63 perpendicular to the newel 14, as illustrated by the various relationships shown in FIG. 4.

In practice, the handrails 20 and 21 are preformed as described with reference to FIG. 3 to provide the desired external decorative appearance. While the handrails are described and shown as being formed out of a common block of wood, it will be apparent that they may be formed out of other materials either individually or together, such as, by molding out of metal or plastic materials. The balusters are preassembled in the manner described, again with the connecting strips 29 pivotally interconnecting opposite ends 43 and 44 of the balusters. Of course, the baluster assemblies are provided in lengths according to the length or spacing between newels. Generally, the decorative appearance of the balusters will be made to conform to the styling or appearance of the handrails and either may be preassembled with the handrails or supplied as individual components to be assembled at the job site. At the job site, the rails 20 and 21 are cut to a length and angle at their ends so as to permit their fastening or assembly flush with the sides of the newels 14. Once cut to length, the baluster assembly is interconnected between the rails 20 and 21 by inserting the connecting strips 29 into the grooves 30 and 40 and injecting a suitable bonding agent into the notches formed between the ribs 32 and 41, respectively, as illustrated in FIG. 3. Here, the ribs 32 and 41 function to provide intervening notches for the injection or application of a bonding agent so that when the connecting strips 29 are inserted in position, they will become adhesively secured to the grooves 30 and 40 in the relationship shown in FIG. 4. The fastener elements 60 are then placed within the end of each rail 20 and 21 and specifically secured by means of the wood screws 61 such that the curved end 63 of each fastener has the outermost point of its convex end surface 64 aligned flush with the end surface of a rail 20 or 21. It will be apparent from a consideration of FIG. 4 that the alignment and positioning of each fastener 60 will vary in accordance with the angle between the end surface of the rail and the newel 14. Accordingly, the exact positioning of the fastener 60 will vary with the angle or pitch between the rail and newel.

After the handrail assemblies have been installed as described between the newels 14, as seen from FIG. 7, filets 54 are provided for insertion in the open end of the channel portion of each rail 20 and 21 between the balusters 22. To this end, each filet 54 is formed with dados 56 along opposite sides thereof, and the filets are cut to a length corresponding to the spacing between balusters and are given an angularity or pitch at their ends corresponding to the angle formed in the end surface of each rail 20 and 21. Thus as seen from FIG. 2, the filet will bridge the open end of the channel with opposite sides 56 overlapping the sides 25, 26 or 35, 36 of each rail.

Preferably, in accordance with the preferred form of the present invention, upper and lower spaced rails 20 and 21 are provided for interconnection of the balusters therebetween. Nevertheless, in certain applications it may be desirable to eliminate the lower rail and to assemble the balusters in pivotally connected relation for insertion within an upper rail. In that event, the lower ends of the balusters 22 may be of conventional square cut construction so as to permit them to be anchored directly into the flooring. A particular feature of the baluster arrangement as described is the curved end construction of the balusters as designated at 48 and 51, respectively, in FIG. 4 so as to permit pivotal movement of the balusters according to the pitch of the rail assembly; yet once installed in place within the handrails 20 and 21, the end surfaces of the balusters will be movable into firm bearing engagement with the inner surfaces of the rails 20 and 21. Of course, variations may be readily adopted to permit the balusters to be freely pivotal in either direction, although the arrangement as described and illustrated with respect to the preferred form offers the definite advantage of greater stability while limiting the swinging or pivotal movement of the balusters in only one direction.

It is therefore to be understood that various modifications and changes may be made in the construction and arrangement of parts as well as the composition of materials comprising the present invention without departing from the spirit and scope thereof as defined by the appended claims.

We claim:

1. An adjustable, prefabricated handrail assembly comprising:

a pair of upstanding end supports;

a rail having a channel portion extending its substantial length;

a plurality of balusters, and means pivotally connecting at least one end of each of said balusters in spaced relation to one another along the length of said rail in concealed relation within said channel for pivotal movement in a direction lengthwise of said rail; and fastener means interconnecting each end of said rail to one of said end supports such that said balusters extend vertically in spaced parallel relation to one another irrespective of the pitch of said rail, each said fastener means defined by a bracket affixed to the inner closed end of said channel portion, said bracket including a connecting end portion having an externally curved surface engageable with the side surface of one of said end supports, and a male connector extending through an open slotted portion in each said connecting end portion interconnecting said bracket to said end support.

2. A handrail assembly according to claim 1, said channel portion in said rail being of generally U-shaped cross-sectional configuration and provided with a slotted portion adapted for lengthwise insertion of said pivotal connecting means for said balusters.

3. A handrail assembly according to claim 2, the slotted portions in said channel portion extending in a lengthwise direction along the sides of said channel for the entire length of said rail, and said pivotal connecting means including a longitudinally extending strip interconnecting the ends of said balusters in predetermined spaced relation to one another.

4. A handrail assembly according to claim 1, each of said balusters provided with a rounded end portion at one end thereof disposed in contiguous relation to the inner closed end of said channel portion.

5. A handrail assembly according to claim 1, the connected ends of said balusters being angularly relieved in one direction to permit pivotal movement of said balusters within said channel in one direction only lengthwise of said rail.

6. A handrail assembly according to claim 1, each said fastener means including a shim interpositioned behind the slotted portion of each said connecting end portion.

7. An adjustable, prefabricated handrail assembly comprising:

a pair of spaced upstanding newels;

upper and lower rails each having a channel portion extending for its substantial length with open ends of said channels disposed in facing relation to one another, each said channel being of generally U-shaped cross-sectional configuration and provided with slotted portions extending in a lengthwise direction along opposite sides of each said channel for the substantial length of said rails;

a plurality of balusters disposed in spaced relation to one another along the length of said rails;

means pivotally connecting the opposite ends of said balusters in concealed relation within said slotted portions of said channels for pivotal movement of said balusters in a direction lengthwise of said rails, said pivotal connecting means including longitudinally extending flat strips disposed parallel to said opposite sides of said channel, each said strip being of a width corresponding to width of an associated one of said slotted portions and inserted into said associated slotted portion, said ends of said balusters pivotally connected to said strips in predetermined spaced relation to one another; and fastener means interconnecting the end of each rail to one of said newels such that said balusters extend vertically in spaced parallel relation to one another irrespective of the pitch of said rails.

8. A handrail assembly according to claim 7, each of said balusters provided with rounded end portions at opposite ends thereof disposed in contiguous relation to the closed ends of said channels.

9. A handrail assembly according to claim 7, opposite ends of each of said balusters being angularly relieved in one direction to permit pivotal movement of said balusters within said channels in one direction only lengthwise of said rails.

10. A handrail assembly according to claim 7, said fastener means defined by a bracket affixed to the closed end of said channel, each said bracket including a connecting end portion having an externally curved surface engageable with the side surface of an end post, and a male connector extending through an open slotted portion in each said connecting end portion interconnecting said bracket to said end post.

11. A handrail assembly according to claim 10, each said fastener means including a shim positioned behind the slotted portion of each said connecting end portion.

12. An adjustable prefabricated handrail assembly according to claim 7, each of said slotted portions provided with closely spaced ribs extending longitudinally therethrough with intervening grooves therebetween and a bonding agent in said grooves to adhesively secure said flat strips within said slotted portions.

13. In a handrail assembly wherein a rail member includes a channel portion extending lengthwise of said rail and an upstanding end support is disposed at least at one end of said rail, the improvement comprising a fastener interconnecting an end of said rail to said end support, said fastener defined by a bracket affixed within said channel portion, said bracket including a slotted connecting end portion of generally convex configuration with the convex surface of said connecting end portion engageable with a side surface of said end support, and a male connector extending through the slotted portion in said connecting end portion for connection to said end support.

14. In a handrail assembly according to claim 13, said fastener including a shim of generally semi-cylindrical configuration adaptable for insertion in said connecting end portion behind said slotted portion, said male connector element being insertable through an opening in said shim aligned with said slotted portion.

* * * * *